US006101803A

United States Patent [19]

Stahlecker et al.

[11] Patent Number: 6,101,803

[45] Date of Patent: Aug. 15, 2000

[54] PROCESS AND APPARATUS FOR PIECING A YARN END IN AN OPEN-END ROTOR SPINNING MACHINE

[75] Inventors: Gerd Stahlecker, Eislingen/Fils; Hans Braxmeier, Suessen, both of Germany

[73] Assignee: Novibra GmbH, Suessen, Germany

[21] Appl. No.: 09/273,505

[22] Filed: Mar. 22, 1999

[30] Foreign Application Priority Data

May 14, 1998 [DE] Germany ..... 198 21 643

[51] Int. Cl.[7] ..... D01H 13/26

[52] U.S. Cl. ..... 57/263; 57/264; 57/408; 57/411; 57/412

[58] Field of Search ..... 57/263, 264, 408, 57/411, 412

[56] References Cited

U.S. PATENT DOCUMENTS

| | | | |
|---|---|---|---|
| 4,059,946 | 11/1977 | Boettcher et al. | 57/34 R |
| 5,584,170 | 12/1996 | Stahlecker | 57/263 |
| 5,640,838 | 6/1997 | Bilner et al. | 57/263 |
| 5,673,548 | 10/1997 | Raasch et al. | 57/412 |
| 5,676,322 | 10/1997 | Stahlecker | 57/263 |
| 5,732,543 | 3/1998 | Bungter et al. | 57/263 |
| 5,916,118 | 6/1999 | Wassenhoven et al. | 57/412 |

FOREIGN PATENT DOCUMENTS

| | | |
|---|---|---|
| 2018701 | 3/1971 | Germany . |
| 19624537A1 | 1/1998 | Germany . |

*Primary Examiner*—William Stryjewski
*Attorney, Agent, or Firm*—Evenson, McKeown, Edwards & Lenahan, P.L.L.C.

[57] ABSTRACT

For piecing a yarn end at a spinning station of an open-end rotor spinning machine, the previously stopped feed roller is re-activated for a short pre-feeding period. The fiber beard, which has been thinned out by the still rotating open roller, can thus renew itself. The fibers which are combed during this pre-feeding period are removed as waste when the spinning rotor is at a standstill. After completion of the pre-feeding period, the feed roller is rotated in reverse so far back until the fiber beard leaves the area of effect of the opening roller. The feed roller is activated again for the actual piecing process.

9 Claims, 4 Drawing Sheets

PROCESS AND APPARATUS FOR PIECING A YARN END IN AN OPEN-END ROTOR SPINNING MACHINE

BACKGROUND AND SUMMARY OF THE INVENTION

This application claims the priority of German application 198 21 643.2, filed in Germany on May 14, 1998, the disclosure of which is expressly incorporated by reference herein.

The present invention relates to a process for piecing a yarn end at a spinning station of an open-end rotor spinning machine, in which process a feed roller, stopped before the piecing operation, is activated for a short pre-feeding period, whereby the end of a sliver, in the form of a fiber beard, is presented to a rotating opening roller for the purpose of renewing the fiber beard, in which process further the single fibers combed from the fiber beard during the feeding period are removed as waste, and in which process the feed roller is re-activated for the actual spinning process. The present invention relates further to an open-end rotor spinning machine for carrying out the process.

In a process of this type described in U.S. Pat. No. 4,059,946, a fiber beard is generated which is uniform in shape and thus permits an exact dosage of fed fibers for the piecing process. This is achieved in that, between the ending of the pre-feeding period and the re-activating of the feed roller for actual piecing, an exact, predetermined further time period is observed. Although single fibers are combed from the fiber beard during this further time period, which single fibers are also removed as waste, still a reproducible fiber beard is created, which comprises a defined amount of fibers and which thus delivers a defined amount of fibers when the feed is re-activated for actual piecing.

The removal of combed single fibers is effected in the case of operating open-end rotor spinning machines usually in that the single fibers to be removed reach the spinning rotor by means of a fiber channel and from there are sucked off over the rotor edge. This functions well as long as the spinning rotor is at a standstill or driven at a very low speed. For piecing, however, as a rule the previously stopped spinning rotor is started up again to reach a piecing speed, during which it can happen that some single fibers, which should be removed as waste, are not suctioned off when the spinning rotor is rotating within a certain speed range, although the centrifugal forces of the spinning rotor while running at a low speed are not really sufficient to hold the single fibers. These "stray" single fibers roll up in the spinning rotor and form so-called fiber nests, which are deposited onto the piecing point of the spun yarn end and thus impair the piecing point in the yarn.

In order to avoid these stray single fibers it is known from the German published patent application 196 24 537, that during the piecing process, a valve is opened on the rotor housing which encases the spinning rotor, through which valve an air stream is blown into the spinning rotor, which supports the action of suctioning off stray single fibers. The air stream is maintained until there are no more stray single fibers left and until the fed single fibers for the actual piecing are held in the spinning rotor by means of centrifugal forces. This procedure, which functions so well in the case of the larger spinning rotors, fails, however, in the case of extremely small spinning rotors having a fiber-guiding diameter of less than 27 mm.

It is an object of the present invention to carry out the piecing process without stray single fibers.

This object has been achieved in that the feed roller is rotated so far in reverse after the pre-feeding period is over that the fiber beard leaves the effective area of the opening roller.

As the opening roller does not comb any more single fibers from the fiber beard after the feed period is over, stray single fibers cannot occur in the first place. Furthermore, the tensile strength of the piecing point is improved by the more even fiber distribution. It is, of course, understood that the feed roller is only rotated in reverse far enough to still permit the fiber beard to be present, as before.

Although it is known from German published patent application 20 18 701 that the feed roller is rotated in reverse by a predetermined distance directly in the case of an end break so that damage to the fibers caused by continued combing of the fiber beard is avoided, and thus that no undesired fibers get into the spinning arrangement, the measures involved in the present invention are not ones to be applied directly in the case of an end break, but are rather to be met in the course of a renewal of a previously combed fiber beard during a piecing process.

In a further advantageous arrangement of preferred embodiments of the present invention, the spinning rotor is stopped until the fiber beard has left the area of effect of the opening roller. This ensures that single fibers combed from the fiber beard, which reach the spinning rotor, are with certainty removed completely as waste. They cannot roll up to form fiber nests in the spinning rotor.

The dosage for actual piecing can be improved when the time delay, corresponding to the reversing of the feed roller, is taken into consideration as a time allowance when the feed roller is activated again for the actual piecing. Thus it is taken into account that the pulled back fiber beard must first reach its actual previous starting position, even when the time allowance only involves fractions of a second.

In order to carry out the process, a traveling piecing device is provided in preferred embodiments according to the present invention, which comprises an auxiliary drive, with which the feed roller can be driven in both rotational directions.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
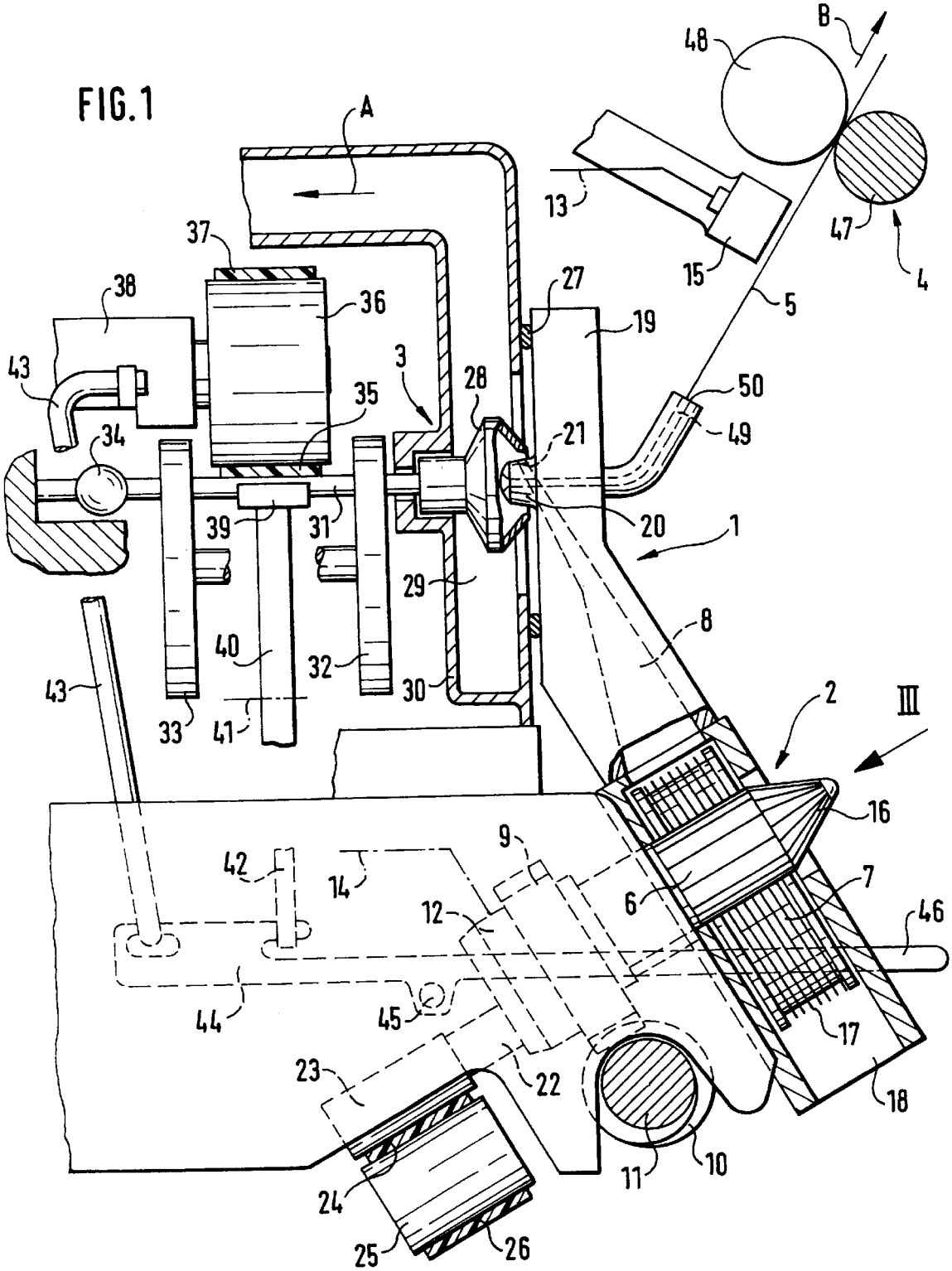
FIG. 1 is a part sectional schematic view of a spinning station of an open-end rotor spinning machine during its operational state, constructed according to preferred embodiments of the invention.

The spinning station 1 shown in FIG. 1 is one of a plurality of stations arranged adjacently to one another in a row in an open-end rotor spinning machine. On each machine side there are, as a rule, at least a hundred such spinning stations 1.

The spinning station 1 comprises as essential component parts a feed and opening device 2, a twist device 3 as well as a withdrawal device 4 for withdrawing spun yarn 5. The yarn 5 is fed, in a way not shown, to a winding device and there wound onto a cross-wind bobbin.

The feed and opening device 2 comprises a feed roller 6 for feeding fiber material (not shown in FIG. 1), an opening roller 7 for opening this fiber material to single fibers, and a fiber feed channel 8 for transporting the single fibers to the twist device 3. This process is generally known in open-end rotor spinning.

The feed roller 6 is extended in axial direction in the inside of the spinning station 1 and connected to a worm wheel 9, which is driven by a worm 10. A worm 10 is arranged at each spinning station 1, whereby all the worms 10 are arranged on a drive shaft 11 extending continuously along the machine in longitudinal direction. A coupling or clutch 12 is provided in the area of the worm wheel 9, by means of which the drive of the feed roller 6 can be interrupted. Thus the feed roller 6 can be stopped when an end break occurs, despite the drive shaft 11 continuing to operate. The coupling 12 is controlled by an end break detector 15, which is located in the area of the withdrawal device 4 and which is connected by means of electric cables 13,14 to the coupling 12.

Towards the operator's side, the feed roller 6 is provided with a conically formed driving pinion 16, by means of which the feed roller 6, when it is separated from the machine side drive, can be driven temporarily by external devices.

The opening roller 7 is provided in the known way with a toothed combing structure 17, which combs the single fibers necessary for the open-end rotor spinning process from the fed fiber material. The opening roller 7 is arranged in an opening roller housing 18, which can be swivelled away from the spinning station 1, whereby the drive shaft 11 is advantageously provided as a swivel axle. The opening roller housing 18 is extended upwards to a cover 19, with which, during operation, the area of the twist device 3 can be covered with the aid of an intermediary sealing ring 27. The cover 19 is provided with a projection 20 facing the twist device 3, in which projection 20 a mouth 21 of the fiber feed channel 8 is located.

The opening roller 7 is arranged on a shaft 22, which has a drive wharve 23 on its rear end, against which drive wharve 23 a drive belt 24 is disposed. The drive belt 24 is advantageously a tangential belt which extends along the longitudinal length of the machine. A tension pulley 25 is arranged at each drive wharve 23, which tension pulley 25 also guides the returning belt end 26 of the drive belt 24. The opening roller 7 is not stopped when an end break occurs.

The twist device 3 comprises a spinning rotor 28, into whose open front side the projection 20 with the mouth 21 of the fiber feed channel 8 projects. The spinning rotor 28 runs in a vacuum chamber 29, which is located in the inside of a rotor housing 30. The vacuum chamber 29 is connected in arrow direction A to a suction device (not shown).

The spinning rotor 28 is pressed onto a shaft 31, which in a known way, is supported radially by means of two supporting disc pairs 32 and 33 and supported in axial direction against a step bearing 34. The shaft 31 is driven by a tangential belt 35 extending in machine longitudinal direction. One tension pulley 36 is provided for each spinning station 1, which tension pulley 36 loads the tangential belt 35 in the area of each shaft 31 and which tension pulley 36 also guides the returning belt end 37 of the tangential belt 35. The suspension arrangement 38 for the tension pulley 36 is only indicated schematically, and is so designed that it can be swivelled together with the tension pulley 36 around an axle (not shown) and loaded by means of a loading spring.

A brake 39 in the form of a clasp brake is arranged at the shaft 31 of the spinning rotor 28. This brake 39 comprises in a known way two pincer arms 40, which by means of an activating device can open and close pincer-like around a swivel axle 41, which is only indicated schematically here. Two brake blocks of the brake 39 can thus be moved below the tangential belt 35 to the shaft 31. The brake 39 can be activated from the operator's side by means of an activating element 42. During braking, the tension pulley 36 is raised from the tangential belt 35, which occurs by means of activating a connecting rod 43 also from the operator's side. The activating element 42 and the connecting rod 43 are applied in the inside of the spinning station 1 on a double-armed brake lever 44. This brake lever 44 can be swivelled around a swivel axle 45 and is activated by means of a working surface 46 from the operator's side. When the working surface 46 is raised, the brake 39 is placed against the shaft 31, while simultaneously the tension pulley 36 is raised.

The withdrawal device 4 comprises a roller pair, which consists of a driven withdrawal cylinder 47 extending in longitudinal direction of the machine, as well as a top roller 48. The withdrawal device 4 withdraws the spun yarn 5, whereafter it is guided in withdrawal direction B to a cross winding mechanism (not shown). A withdrawal channel 49 is part of the withdrawal device 4, which channel 49 begins in the projection and out of whose exit opening 50 the yarn 5 exits during operation.

Figure 2:
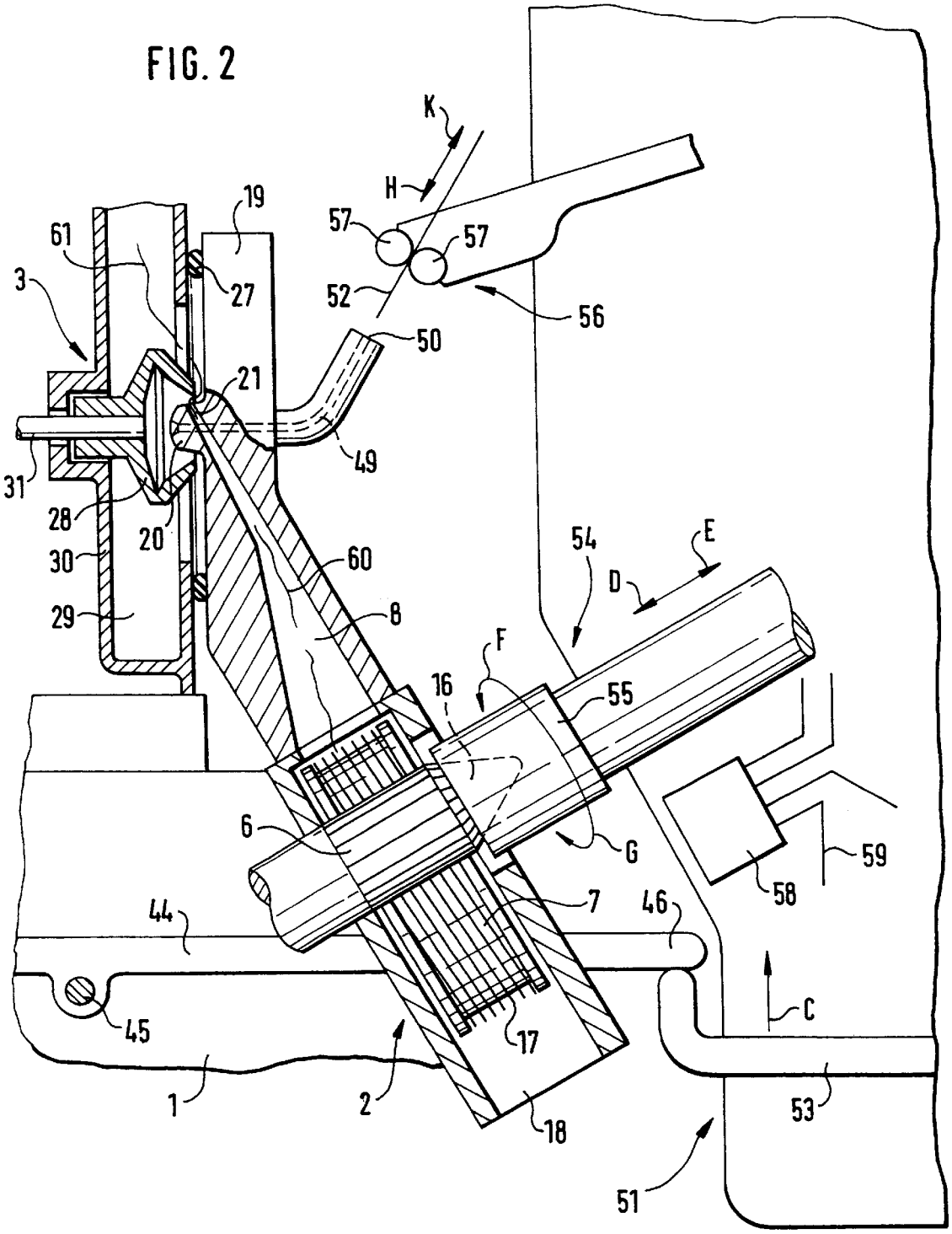
FIG. 2 is a schematic view of a piecing device located at the spinning station of FIG. 1, wherein said piecing device is showing removing an end break.

In FIG. 2, the only part of the spinning station 1 shown is the area of the operator's side, whereby it is presumed that an end break has occurred.

In order to repair the end break, a piecing device 51 is guided in a known way to a spinning station 1. By means of this piecing device 51, a yarn end 52 connected to the cross-winding bobbin is pieced to a fiber ring located in the spinning rotor 28. For this purpose, the yarn end 52 must be guided backwards through the withdrawal channel 49 and into the inside of the spinning rotor 28. The piecing device 51 comprises a plurality of function elements, of which in the following only those which are essential to the actual present invention are described.

The piecing device 51 comprises firstly devices 53 for activating and releasing the brake 39, whereby only one of these devices 53, a lever engaging the working surface 46 of the brake lever 44 in activating direction C, is shown. By means of these devices 53, the spinning rotor 28 can be stopped during a piecing process, whereby the tension pulley 36 is raised in a manner described above. Stopping the spinning rotor 28 serves primarily the purpose of clearing the inside of the spinning rotor 28 of fiber ends when the opening roller housing 18 is swivelled back.

The piecing device 51 comprises further an auxiliary drive 54, which has a drive head 55 having an inner cone, which can be arranged to engage the drive pinion 16 according to the direction D and which can be drawn back according to the other arrow direction E. Thus the feed roller 6, when decoupled from its machine side drive, can be driven temporarily from the outside. The drive head 55 can be driven in both directions F and G. The reason for this is described below.

The piecing device 51 comprises in addition a feeder 56, at whose end facing the spinning station 1 an auxiliary withdrawal roller pair 57 is applied. This auxiliary withdrawal roller pair 57 can be driven in both directions according to the double arrow H–K, so that the yarn end 52 can be guided back into the spinning rotor 28 and a spun yarn 5 later withdrawn again.

All the function elements applied to the piecing device 51, including those not shown, are controlled, using electrical transmission, by a control program 58.

As, when the feed roller 6 is stopped, the opening roller 7 continues to operate, single fibers 60 continue to be combed from the fiber material, which reach the inside of the spinning rotor 28 through the fiber feed channel 8. As soon as the piecing device 51 has stopped the spinning rotor 28, these single fibers 60 are removed as waste 61 by means of the vacuum chamber 29 and the suction device (not shown). The course of the piecing process is described below in detail in connection with FIG. 5.

Figure 3:
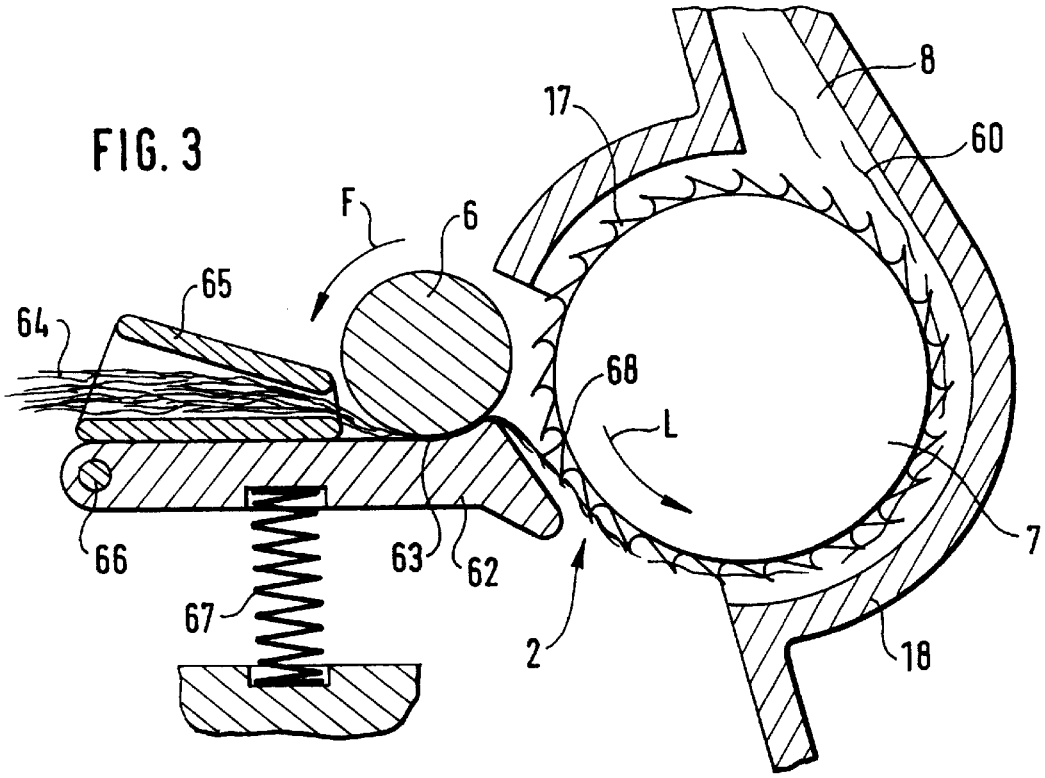
FIG. 3 is a part intersectional view in the direction of arrow III of FIG. 1 onto a part of the feed and opening arrangement, shown while a fiber beard is being combed.

As can be seen from FIG. 3, a nipping element 62 in the form of a feed table is arranged at the feed roller 6 rotating during operation in direction F, which nipping element 62, together with the feed roller 6, forms a nipping point 63 for a fed sliver 64. The nipping element 62 can be swivelled around a swivel axle 66 and pressed to the feed roller 6 by means of a loading spring 67. An entry condenser 65 for guiding in and condensing the sliver 64 is arranged upstream of the feed roller 6.

During normal spinning operation a fiber beard 68 forms adjoining the nipping point 63, which fiber beard 68, by means of the toothed combing structure 17 of the opening roller 7, is constantly combed to single fibers 60. During normal operation, these single fibers 60 collect to form a fiber ring and are spun to a yarn 5.

If an end break does occur, the feed roller 6 is immediately stopped, as described above, while the opening roller 7 continues to rotate at an undiminished speed in rotational direction L. Despite the stopped feed roller 6, the fiber beard 68 continues to project into the toothed combing means 17 and thins out more and more. The single fibers 60, which continue to be combed, still reach the spinning rotor 28, from which, as a result of the broken yarn 5, they are no longer withdrawn, but rather remain in the inside of the spinning rotor 28 as long as it rotates. The unspun fibers remaining in the spinning rotor 28 must be removed therefrom during a clearing process, for which the spinning rotor 28 is stopped, or driven at a very low speed by the piecing device 51.

When the feed roller 6 is at a standstill, the continuously thinned out fiber beard 68 acquires an unknown number of fibers, so that allotting fibers for a subsequent piecing process is not possible. For this reason it is necessary to first renew the fiber beard 68 by means of the piecing device 51, so that it again contains the known full amount of fibers. To this purpose, the stopped feed roller 6 is driven externally for a short period of time by means of the auxiliary drive 54 at the beginning of the piecing process, namely until the fiber beard 68 has renewed itself completely. During this period of time, the spinning rotor 28 is braked by means of the activating device 53, so that when the fiber beard 68 is being renewed, combed single fibers 60 can be removed as waste 61.

In the case of the process described above in prior art, the feed roller 6 is again stopped with the aid of the auxiliary drive 54 after the fiber beard 68 has been renewed. Based on prior art it was assumed that after the feed roller 6 was stopped and the start of the actual feed for piecing, there was a defined time span, during which the fiber beard 68 was thinned out in a reproducible way, so that despite repeated combing the number of fibers in the fiber beard 68 was known. It can happen, however, that when the fiber beard 68 is being regulated, that not all single fibers 60 are removed as waste 61, as, for the piecing process, the spinning rotor 28 begins to rotate again. Thus single fibers 60, which are not planned for actual piecing, can remain as stray fibers in the spinning rotor 28 and roll up in an undesired way to form a fiber nest, which is deposited around the piecing point as soon as the yarn end 52 is guided back into the spinning rotor 28.

Figure 4:
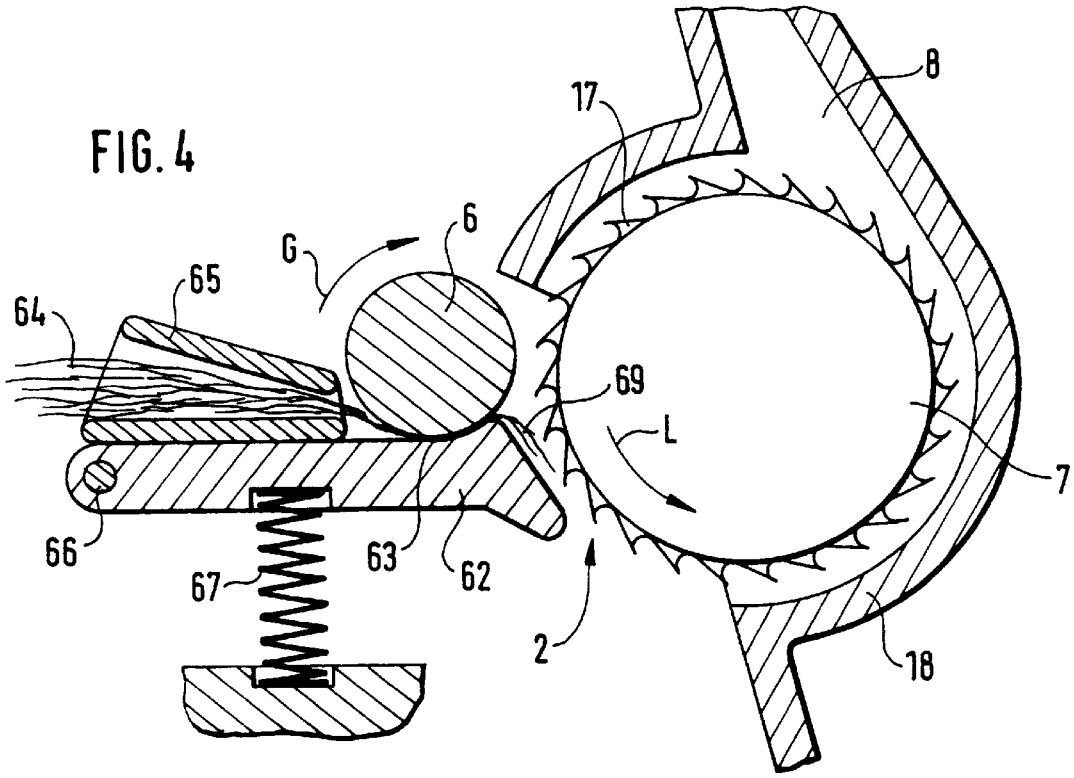
FIG. 4 is a view similar to FIG. 3 shown after the fiber beard has been drawn back.

According to the present invention as shown in FIG. 4, in order to avoid this, the feed roller 6 is rotated in reverse a short distance in rotational direction G by means of the auxiliary drive 54 after the fiber beard 68 has been renewed, namely until the fiber beard 68 has left the toothed combing means 17 of the opening roller 7. This drawn back fiber beard is denoted in FIG. 4 with the reference number 69. This means that, in accordance with the present invention, after the fiber beard 68 has been renewed, absolutely no more stray single fibers 60 are combed, but rather the drawn back fiber beard 69, as shown in FIG. 4, is maintained in its complete consistency. Thus no stray single fibers 60 can roll up to form a fiber nest in the spinning rotor 28 which has started to rotate again. The feed roller 6 is only then driven again in rotational direction F by means of the auxiliary drive 54 for actual piecing, namely at a point in time at which the spinning rotor 28 has reached a sufficient speed for holding the single fibers 60. This speed is reached when the centrifugal forces in the spinning rotor 28 are sufficient to keep the single fibers 60 at the rotor wall.

The entire piecing process, insofar as it is essential for the present invention, is described below with the aid of the process diagram of FIG. 5. It should be noted here that this process diagram is not to scale, either time wise or with regard to the speeds, but rather it serves to illustrate a qualitative description of the process.

Figure 5:
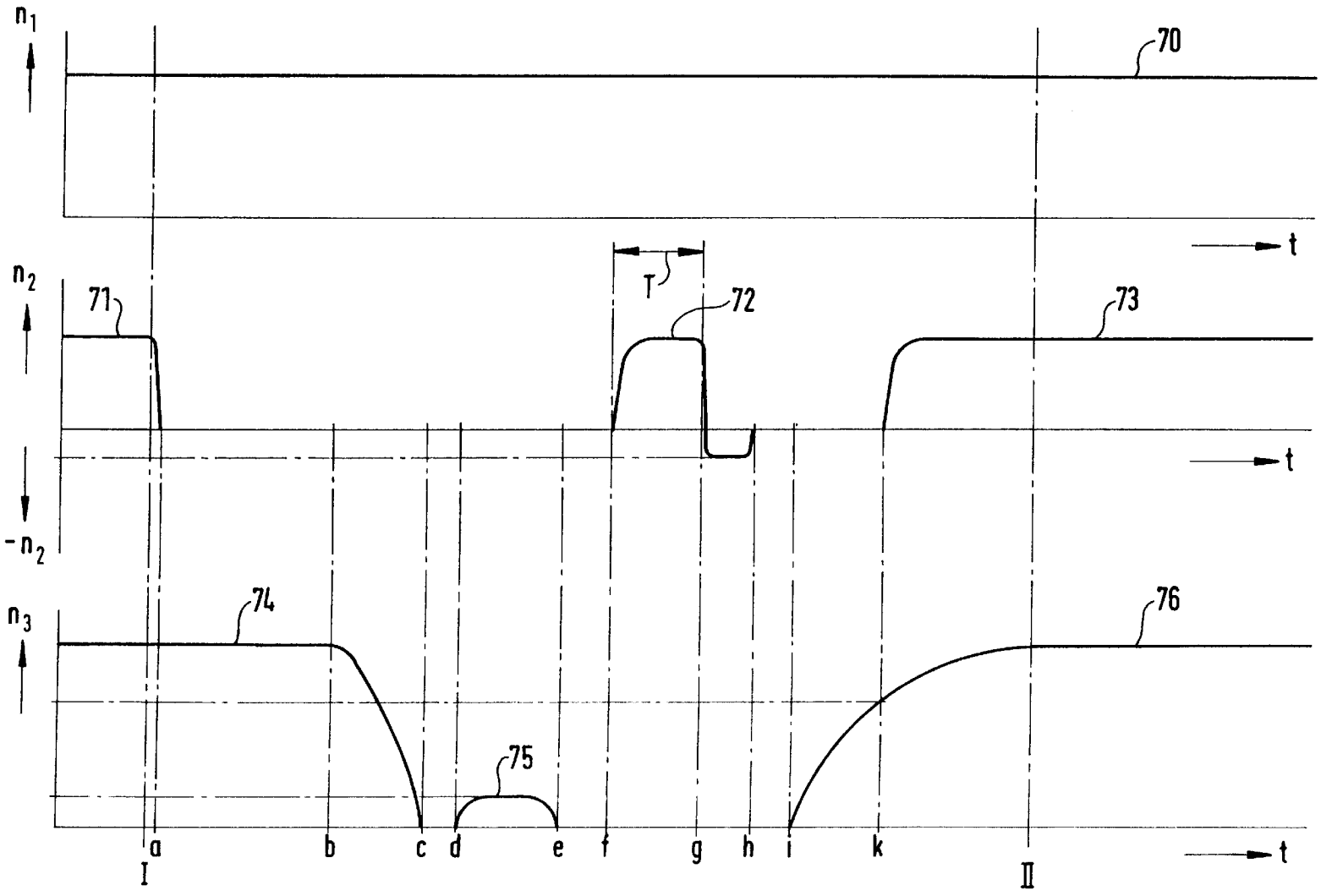
FIG. 5 is a sequence chart, not to scale, representing the process steps according to the present invention.

The process diagram according to FIG. 5 comprises three ordinates, of which $n_1$ represents the speed of the opening roller 7, n2 the speed of the feed roller 6 and n3 the speed of the spinning rotor 28. The time axis t is disposed on each abscissa.

The speed curve of the opening roller 7 is denoted with the reference number 70. The individual speed curves of the feed roller 6 have the reference numbers 71,72 and 73. The speed curves of the spinning rotor 28 are denoted by 74,75 and 76.

It is presumed that at a time I (see broken line) an end break occurs. This end break is repaired after the piecing device 51 arrives at the relevant spinning station 1, and it is further presumed that at a point in time II (see other broken line) the normal spinning process is restored.

As can be seen, the speed $n_1$ of the opening roller 7 remains constant throughout, despite the occurring end break. Thus this gives rise to the problems explained above, which make apportioning a fiber amount during the piecing process difficult.

The speeds $n_2$ and $n_3$ are treated jointly, as they are dependent on one another. There are, of course, other further functions of the piecing device 51 active during a piecing process, which functions can, however, be omitted here.

When at a point in time I an end break occurs at a spinning station 1, the relevant feed roller 6, controlled by the yarn break detector 15, comes directly thereafter to a standstill at a time a. One can see that this time a is almost identical to the time I, namely due to the fact that the feed roller 6 runs only very slowly during operation. From the time a up until the piecing device 51 arrives, the spinning station 1 is left to its own devices for an unspecified length of time. During this time, the opening roller 7 and also the spinning rotor 28 continue to rotate without reducing speed.

It is now presumed that at a time b, the piecing device 51 arrives at the non-operational spinning station 1. The piecing device 51 activates by means of its devices 53 firstly the brake 39 and stops the spinning rotor 28. As spinning rotors 28 today rotate at greatly higher speeds than 100,000 rpm, the spinning rotor 28 comes to a standstill only after a somewhat longer time span, in the present case at time c. Now the feed roller 6 and the spinning rotor 28 are stopped, while only the opening roller 7 continues to rotate.

After the spinning rotor 28 has been stopped, the remaining fibers caught in its inside have to be removed, which is not solely possible by means of the machine-side suction. For this reason, the cover 19 is usually removed by means of swivelling, so that clearing elements (not shown) can clear the inside of the spinning rotor 28. It is in addition usual to permit the spinning rotor 28 to rotate very slowly by means of an external drive (not shown), so that the clearing elements reach every part of the spinning rotor 28. This rotor clearing is represented by the speed curve 75 between times d and e.

After the spinning rotor 28 has been cleared, and when the cover 19 is closed again, single fibers 60 continue to be combed from the fiber beard 68. These fibers 60 reach the spinning rotor 28, but are now—when the spinning rotor 28 is still stopped—immediately suctioned off over the front rotor edge by the suction device. However, the amount of fibers present in the fiber beard 68 at this time is not known. For this reason it is provided that from a time f the fiber beard 68 is renewed in the way described above, so that the fiber amount present is known for the purpose of apportioning. This is achieved in that, by means of the auxiliary drive 54, the feed roller 6 is driven at the time f, although the feed roller 6 is decoupled from the drive shaft 11. This is shown by the speed curve 72, and the renewal of the fiber beard 68 takes from time f to time g. This timespan is denoted as the pre-feed time span T.

At the time g, the feed roller 6 is not simply stopped, as was previously the norm, but rather the feed roller 6 is driven slowly in reverse according to the rotational direction G (see also FIG. 4) by means of the auxiliary drive 54. The feed roller 6 rotates only so far as to permit a drawn back fiber beard 69 to still project partly over the nipping point 63. Only then is the feed roller 6 stopped. This is the case at the time h. The drawn back fiber beard 69 no longer reaches into the toothed combing structure 17 of the rotating opening roller 7, so that absolutely no stray single fibers 60 are combed from the fiber beard 69.

Now the piecing device 51 can release the brake 39 again by means of its devices 53, so that the spinning rotor 28, from the time i, runs up to its operational speed. The run-up curve 76 of the spinning rotor 28 can be artificially stretched somewhat, for example by raising the tension pulley 36 several times by means of the piecing device 51. While the spinning rotor 28 is running up, the actual piecing takes place, namely by means of re-activating the feed roller 6 at a time k and by means of guiding the yarn end 52 back into the spinning rotor 28. As soon as the yarn end 52 has reached the collecting groove of the spinning rotor 28, it finds there newly fed-in fibers in the form of a fiber ring, so that piecing can take place. Thus a yarn 5 is immediately withdrawn by means of the feeder 56, which yarn 5 has a piecing point on which there is no fiber nest. The entire piecing process is completed before the spinning rotor 28 has fully run up to its operational speed. The piecing device 51 can leave the spinning station 1 from the time II.

The piecing process is, naturally, much more complicated then described above. Only those measures which were relevant to the present invention were disclosed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for piecing a yarn end at a spinning station of an open-end rotor spinning machine, said spinning station comprising a feed roller for feeding a sliver, an opening roller for combing the sliver to single fibers, and a spinning rotor, said process comprising the following steps:

stopping the feed roller after a yarn break has occurred, while the opening roller is still rotating, starting the feed roller for a short pre-feed time span to thereby present the end of the sliver in the form of a fiber beard to the rotating opening roller for the purpose of renewing the fiber beard, removing the single fibers combed from the fiber beard during the pre-feed time span as waste, reversing the feed roller so far back after completion of the pre-feed time that the fiber beard leaves an effective area of the opening roller, and re-activating the feed roller and performing the actual piecing.

2. A process according to claim 1, wherein the spinning rotor is stopped for a period of time before the fiber beard has left the effective area of the opening roller during the step of reversing the feed roller.

3. A process according to claim 2, wherein a time delay corresponding to the reverse rotation of the feed roller when said feed roller is activated for actual piecing is taken into consideration as a time allowance.

4. A process according to claim 1, wherein a time delay corresponding to the reverse rotation of the feed roller when said feed roller is activated for actual piecing is taken into consideration as a time allowance.

5. An open-end rotor spinning machine comprising a plurality of spinning stations and a traveling piecing device arrangeable at each spinning station, whereby each spinning station comprises:

a feed roller which is stopped in the event of an end break, said feed roller forming together with a nipping element a nipping point for feeding a sliver, an opening roller which continues to rotate in the event of an end break, and a spinning rotor which is stopped by means of a brake and which spinning rotor is housed in a rotor housing which is connected to a suction device, wherein the piecing device is provided with devices for activating and releasing the brake, with an auxiliary drive for driving the feed roller, and with a control program for carrying out a piecing, and wherein the feed roller is driven in both directions by means of the auxiliary drive to facilitate moving a prepared fiber beard for piecing backwards away from the opening roller.

6. A yarn piecing process for an open-end rotor spinning machine having a sliver feed device supplying sliver to an opening device which combs the sliver to single fibers, said process comprising:

stopping the sliver feed device in response to a yarn break, while continuing operation of the opening device, starting the feed device for a short pre-feed time to thereby present a sliver end in the form of a fiber beard to the opening device for the purpose of renewing a fiber beard at said sliver end, removing single fibers combed from the fiber beard during the pre-feed time, reversing the sliver feed device so that the fiber beard leaves an effective area of the opening device, and reactivating the sliver feed device and performing piecing.

7. A process according to claim 6, wherein the sliver feed device includes a rotatable feed roller, and wherein the opening device includes an opening roller.

8. An open-end rotor spinning machine assembly comprising:

a sliver feed device supplying sliver to an opening device which combs the sliver to single fibers, and control means for carrying out the following sequential steps:

stopping the sliver feed device in response to a yarn break, while continuing operation of the opening device, starting the feed device for a short pre-feed time to thereby present a sliver end in the form of a fiber beard to the opening device for the purpose of renewing a fiber beard at said sliver end, removing single fibers combed from the fiber beard during the pre-feed time, reversing the sliver feed device so that the fiber beard leaves an effective area of the opening device, and reactivating the sliver feed device for piecing.

9. A machine assembly according to claim 8, wherein the sliver feed device includes a rotatable feed roller, and wherein the opening device includes an opening roller.

* * * * *